United States Patent [19]

Kobayashi et al.

[11] 3,998,513

[45] Dec. 21, 1976

[54] MULTI-CONTACT INTERCONNECTORS

[75] Inventors: Gensuke Kobayashi, Omiya; Akio Nakamura, Kawaguchi, both of Japan

[73] Assignee: Shinetsu Polymer Co., Ltd, Tokyo, Japan

[22] Filed: Jan. 28, 1976

[21] Appl. No.: 653,125

[30] Foreign Application Priority Data

Jan. 31, 1975 Japan ..... 50-13166

[52] U.S. Cl. ..... 339/59 M; 339/17 M; 339/DIG. 1; 339/DIG. 3; 156/85; 156/250; 174/DIG. 8

[51] Int. Cl.[2] ..... H01R 13/40

[58] Field of Search ..... 339/17, 59, 61, DIG. 1, 339/DIG. 3; 174/DIG. 8, 317, 338, 29; 156/85, 250

[56] References Cited

UNITED STATES PATENTS

| | | | |
|---|---|---|---|
| 3,680,037 | 7/1972 | Nellis et al. | 339/61 M |
| 3,858,958 | 1/1975 | Davies | 339/17 LM |

*Primary Examiner*—Joseph H. McGlynn
*Attorney, Agent, or Firm*—Toren, McGeady and Stanger

[57] ABSTRACT

A multi-contact interconnector composed of conductive material which is always elastomeric and insulating material which may be elastomeric or not, but should be heat-shrinkable, the two materials being arranged alternately in layers one upon another. The outer periphery of each insulating layer being partly or entirely recessed below the level of the flat surface of each conductive layer such that the flat surfaces of the conductive layers make electric contacts with greatly improved reliability.

9 Claims, 5 Drawing Figures

MULTI-CONTACT INTERCONNECTORS

BACKGROUND OF THE INVENTION

This invention relates to multi-contact interconnectors for connecting electric terminal points and, in particular, to novel and improved interconnectors that are flexible and valuable for use in the electric circuits of various kinds of precision electronic devices.

Along with the increasing trend in solid state electronic circuits toward miniaturization more and more, demand is rapidly growing for smaller and smaller interconnectors having the smallest distances between contact points. Miniature interconnectors with shock-proofness and reliability against vibration have been eagerly desired especially for display circuits in various kinds of precision portable devices, such as, dashboards of automobiles, pocketsize electronic calculators, electronic watches and the like.

Proposed as materials suitable for forming the contact points of the interconnectors of the above kind are various electrically conductive rubbery elastomers including silicone rubber rendered electro-conductive by adding a highly conductive filler, such as, carbon black or metal powder. These electrically conductive rubbery materials are capable of imparting to interconnectors good reproducibility and reliability against shocks and vibrations as well as wide versatility in shapes, dimensions, electric conductivity and distances between contact points.

An example of interconnectors manufactured using above electrically conductive rubbers materials as a the material for contact points is the so-called "striped" interconnector wherein of each conductive filler-containing silicone rubber layer and each nonconductive silicone rubber layer are stratified and lie one upon another. The stripe-type interconnectors are very valuable for use in liquid crystal displays and for contacting to substrates of printed circuits. However, it has been found that they are not always satisfactory with respect to contact uniformity and reliability, since their surfaces are smooth or flat, despite the resilience of the materials. These conventional multi-layer interconnectors possess the disadvantage of the possibilities of occasional failures in making reproducible electric contacts and consequently, abnormal operations of the circuits and devices.

SUMMARY OF THE INVENTION

The object of this invention is therefore to provide novel and improved multi-contact interconnectors which are free from the above described disadvantages.

The interconnector provided by the invention is composed of alternate layers of electrically conductive and necessarily elastomeric material and electrically insulating, heat-shrinkable material, either elastomeric or not, in the form of a stratified block, each insulating layer having heat-shrinkage in its surface perpendicular to the direction of stratification. As against the thus shrinked peripheries of the electrically insulating, heat-shrinkable layers, the peripheries of the electrically conductive layers become protuberant, forming bulged contact points.

The interconnectors of the present invention may be "striped" interconnectors as conventionally called by their appearance, because of alternately stratified layers of a dark conductive material and a whitish insulating material, but they are characterized by the peripheries of the insulating layers which are recessed by heat shrinkage as against those of the conductive layers.

The protuberance of the peripheries of the electrically conductive layers produces a high reliability of electric contact and much improvement in the leakage characteristics as compared to the prior art interconnectors having flat peripheral surfaces, because the electric contact is made only at the bulged peripheries of the conductive layers when used as interconnectors for liquid crystal units, printed circuit substrates and the like.

BRIEF DESCRIPTION OF THE DRAWING

The drawing illustrates the manufacturing process of preferred embodiments of the interconnectors of the present invention with reference to the description of the examples to follow.

DETAILED DESCRIPTION OF THE PREFERRED EMBODIMENTS

Figure 1:
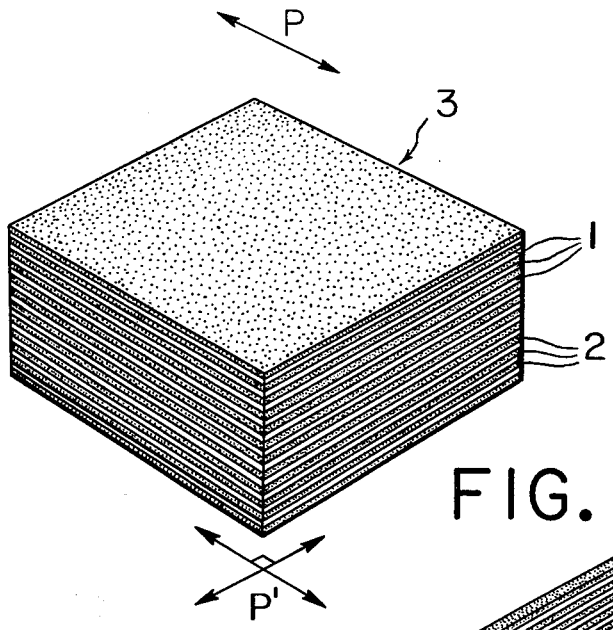
FIG. 1 shows a block 3 formed by the alternately stratified layers of an electrically conductive material 2 and an electrically insulating, heat-shrinkable material 1 bonded to each other.

To describe the present invention in further detail, the material of the electrically insulating, heat-shrinkable layers is not limited to specific ones, but it may be conventional heat-shrinkable plastics in the form of sheets obtained by stretching sheets of thermoplastic resins, such as, polyethylene, polypropylene and polyvinylchloride. However, the most preferred of the electrically insulating, heat-shrinkable material suitable for the purpose is a heat-shrinkable silicone rubber.

The heat-shrinkable silicone rubber useful in the present invention may be prepared by adding to a diorganosiloxane gum, a filler and optionally a pigment as the coloring agent and any other suitable additives and then uniformly hot mixing the resulting compound with a heat-shrinkability imparting agent by a blending machine, such as, a kneader. The fillers are exemplified by finely divided silica fillers, such as, fumed silica, precipitated silica, diatomaceous earth and quartz powder, calcium carbonate and titanium dioxide. The pigments are exemplified by inorganic pigments, such as, iron oxide and thermally stable organic pigments, such as, Prussian blue and phthalocyanine pigments. Further, the heat-shrinkability imparting agents are also known in the prior art and selected from organic thermoplastic materials, such as, polyethylene and polymethylmethacrylate and thermoplastic silicone resins.

The thermoplastic material as the heat-shrinkability imparting agent is usually formulated in an amount ranging from 5 to 75 parts by weight per 100 parts by weight of the diorganopolysiloxane gum depending on the desired heat-shrinkability and the kinds and amounts of the fillers and the other additives (See, for example, U.S. Pat. No. 3,814,723).

The silicone rubber composition obtained above is cooled down to room temperature, admixed uniformly with an organic peroxide employed conventionally as a curing agent, such as, benzoyl peroxide and shaped into sheets of a certain thickness by a roller, followed by heating under pressure in a metal mold to cure. The cured silicone rubber elastomer sheet thus obtained is then subjected to stretching by applying uniaxial or biaxial tension at an elevated temperature higher than the softening point of the thermoplastic material and cooled down to room temperature without releasing the tension for stretching to produce an electrically insulating, heat-shrinkable silicone rubber sheet. The stretching is usually in the range from 50% to 200% based on the dimensions of the unstretched sheet. Too much stretching affects the dimensional accuracy of the finished interconnectors.

It may be added that when the heat-shrinkability of the material is biaxial, an advantage is provided in the leakage characteristics of the finished interconnectors due to the increased distances along the surface between the contact points.

On the other hand, the electrically conductive layers, which must have rubber-like elasticity to secure reliable contact characteristics, are made of a natural or synthetic rubber (e.g., chloroprene rubber and urethane elastomers), preferably a silicone rubber, formulated with a filler capable of imparting electroconductivity to the rubber. For example, an electrically conductive silicone rubber sheet is prepared with an electrically conductive silicone rubber composition composed of a diorganopolysiloxane gum, a conductivity-imparting filler, such as, carbon black, graphite powder, metal powders and certain kinds of metal oxide powders (e.g., powder of stannic oxide), and a curing agent, such as, dicumyl peroxide, di-tert-butyl peroxide 2,4-dimethyl-2,4-di-tert-butyl peroxyhexane, benzoyl peroxide and tert-butyl perbenzoate, by shaping the composition into a sheet and curing the sheet at an elevated temperature under pressure.

The amount of the conductivity imparting filler is usually in the range from 10 to 2,000 parts by weight per 100 parts by weight of the diorganopolysiloxane gum depending on the kind of the filler and the desired electroconductivity.

As is understood from the process for the manufacture of the interconnect of the present invention described hereunder, the interconnectors of the present invention composed of an alternate stratification of electrically insulating, heat-shrinked silicone rubber layers and electrically conductive layers of silicone rubber filled with carbon black possess the advantages of ease in mass production and mechanical workability, electric properties and chemical stability without danger of corrosiveness against other parts coming into contact therewith.

A typical process for manufacturing the interconnector of the present invention will now be described below. In the first step of the process, sheets of an electrically conductive silicone rubber and an electrically insulating, heat-shrinkable silicone rubber are stacked alternately one upon another and bonded together into a stratified block. The heat-shrinkability of the electrically insulating silicone rubber is either uniaxial or biaxial, depending on the intended use of finished interconnectors. In any way, it is necessary to align each heat-shrinkable sheets within the plane perpendicular to the direction of stratification in the same direction with respect to the axis or axes of shrinkability.

The thickness of each conductive or insulating sheet should be carefully determined since it is a determinant parameter for the width of the individual contact points or the distance between two neighboring contact points. Besides, the number of the conductive and insulating layers should also be determined in accordance with the design of the desired finished interconnector.

In the bonding of the stacked sheets together into a block, an appropriate adhesive is employed, if necessary, in order to obtain sufficient bonding strength according to the combination of the materials of the sheets. An advantage is provided in the combination of sheets of an electrically insulating, heat-shrinkable silicone rubber and an electrically conductive silicone rubber where satisfactory bonding of the sheets into a block is attained simultaneously with the curing of the uncured conductive rubber by merely heating the stacked sheets under pressure without the use of any adhesives.

In the second step of the manufacturing process, the stratified block obtained in the first step is cut in the direction of stratification into pieces in provisional forms. For example, the provisional forms of sheets or plates of the alternate layers can be obtained by cutting the block in parallel planes in the direction of the stratification. As a further example, the provisional form of rods of the alternate layers can be obtained by cutting the block in the direction of the stratification to make columns having the desired, cross section, e.g., rectangular or circular.

The provisional forms obtained from the block may be selected to have suitable dimensions for use of the finished interconnectors.

The third step of the manufacturing process is to heat the provisional form of the interconnector obtained in the second step at the temperature of heat-shrinkage of the electrically insulating, heat-shrinkable material so that the shrinkage of the material is effected. The heat-shrinkage causes the peripheries of the insulating layers to become recessed, resulting consequently in the bulged peripheries of the conductive layers.

There is no question, of course, that the interconnector of the present invention may be manufactured by the heat treatment of a stratified block itself (not the pieces cut from the stratified block) from the alternate insulating and conductive layers obtained by directly bonding those layers in a provisional form corresponding to the desired finished interconnector.

The advantages attained by the interconnectors of the present invention compared to prior art interconnectors may be as follows. Firstly, far better contact characteristics are obtained, since the contact points formed by the peripheries of the electrically conductive layers bulge from the peripheries of the electrically insulating, heat-shrinked layers. This is different from the prior art interconnectors in which the peripheries of the electrically conductive and insulating layers are in the same plane and form flat surfaces. Secondly, the leakage characteristics are greatly improved, since the distances between the contact points along the recessed surface in the interconnectors according to this invention are much larger than those between the contact points along the flat surface in the prior art interconnectors, though the direct distances between the contract points are equal.

Following are the examples to illustrate but not to limit the scope of the present invention.

EXAMPLE 1

Electrically insulating, uniaxially heat-shrinkable sheets of 100 mm × 100 mm × 1 mm were prepared by cutting open longitudinally a commercially available heat-shrinkable silicone rubber tube, ST 170DG (product of Shin-Etsu Chemical Co., Japan), with 1 mm wall thickness having been subjected to 100% stretching.

On the other hand, electrically conductive, uncured silicone rubber sheets of 100 mm × 100 mm × 1.04 mm were prepared by shaping a silicone rubber composition obtained by blending 100 parts by weight of an electrically conductive silicone rubber compound filled with carbon black, KE 3701U (product of Shin-Etsu Chemical Co.), and 3 parts by weight of a curing agent C-3 (product of the same company) containing 20% by weight of dicumyl peroxide.

Twelve sheets of the electrically conductive uncured silicone rubber and 11 sheets of the electrically insulating, heat-shrinkable silicone rubber above were stacked alternately on each other, the axes of shrinkability of the latter sheets being in the same direction as shown by the arrow P in FIG. 1. The stack was heated in a metal mold at 160° C for 1 hour under the pressure of 1.2 kg/cm$^2$, followed by cooling without releasing the pressure down to room temperature to form a stratified block of 96 mm × 96 mm × 23 mm.

Figure 3:
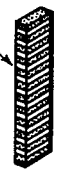
FIG. 3 shows a rod 5 with rectangular cross section obtained by cutting plate 4 with both planes perpendicular to the plate surface and parallel to the direction of stratification.
Figure 2:
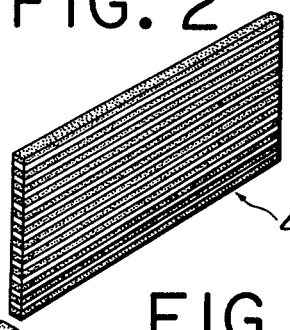
FIG. 2 shows a plate 4 obtained by cutting block 3, with two planes both parallel to the direction of stratification.

The block thus obtained was cut with parallel planes in the direction of the stratification into plates 96 mm × 23 mm × 2 mm as shown in FIG. 2 and the plates were further cut into rods 23 mm × 5 mm × 2 mm as shown in FIG. 3, which were the provisional forms of the finished interconnectors.

Figure 4:
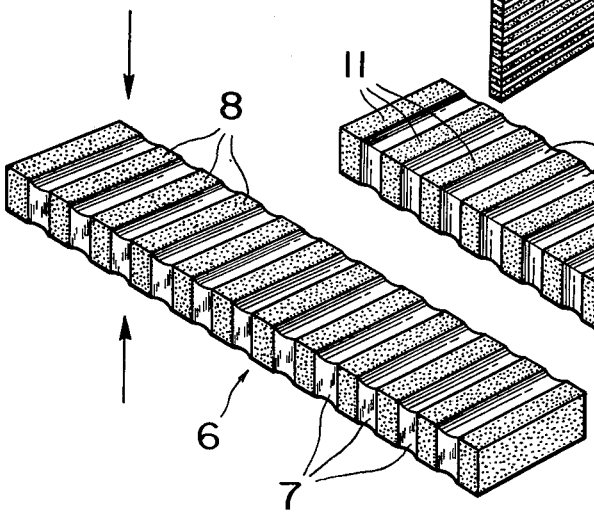
FIG. 4 shows a finished interconnector 6, in which the heat-shrinkage of the electrically insulating, heat-shrinkable layers 7 has been effected uniaxially in the vertical direction indicated by the arrows, while the electrically conductive layers 8 remain unchanged.

Finally, the rod-like provisional forms above were subjected to heat treatment at 200° C for 5 minutes to effect the shrinkage of the electrically insulating, heat-shrinkable layers, by which the peripheries of the electrically insulating layers became recessed in the direction as shown by the arrows in FIG. 4 to produce the desired interconnectors with the protuberant contact points in the form of bulged lines.

EXAMPLE 2

One hundred parts by weight of silicone rubber compound, KE 151U (product of Shin-Etsu Chemical Co.) and 20 parts by weight of polyethylene, Sholex 5003 (product of Showa Petrochemical Co., Japan) were hot blended together and, after cooling to room temperature, 1 part by weight of a curing agent containing 50% by weight of benzoyl peroxide, C-1 (Shin-Etsu Chemical Co.) was added to the mixture. The resultant composition was shaped into sheets 2 mm thick and the sheets were, after curing at 120° C for 10 minutes under the pressure of 1.2 kg/cm$^2$, subjected to biaxial stretching of 100% with respect to area into electrically insulating, heat-shrinkable sheets 1 mm thick.

Eleven square sheets 100 mm × 100 mm taken from the above-obtained electrically insulating, heat-shrinkable sheets and 12 sheets of the same uncured electrically conductive silicone rubber sheets as in Example 1 were alternately stacked on each other as shown in FIG. 1 with the axes of the shrinkability of the former sheets aligned in the same direction as shown by the arrows P' in FIG. 1 and the stack was subjected to heat treatment at 160° C for 1 hour under a pressure of 1.5 kg/cm$^2$ followed by cooling down to room temperature to give a stratified block without releasing the pressure.

The stratified block was cut as shown in FIGS. 2 and 3 with parallel planes in the direction of stratification to produce the provisional forms of the interconnectors with the dimensions 23 mm × 5 mm × 2 mm.

Finally, the provisional forms of the interconnectors were subjected to heat treatment at 200° C for 5 minutes to effect the shrinkage of the electrically insulating, heat-shrinkable layers.

Figure 5:
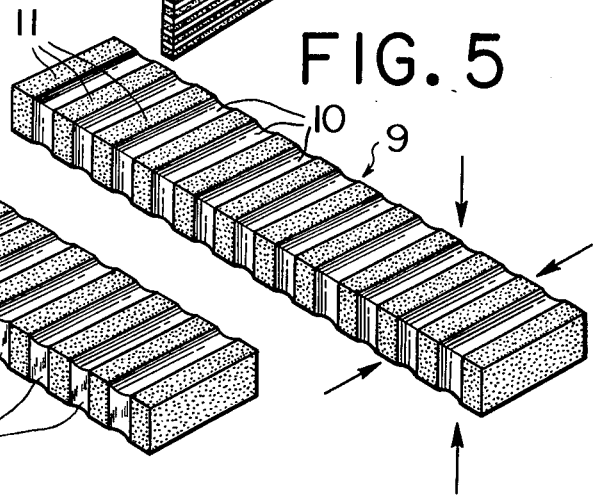
FIG. 5 is another finished interconnector 9, in which the heat-shrinkage of the electrically insulating, heat-shrinkable layers 10 has been effected biaxially in the vertical and horizontal directions as indicated by two sets of the arrows, while the electrically conductive layers 10 remain unchanged.

The interconnector of the present invention thus obtained was of a rod-like form with the peripheries of the electrically insulating layers recessed as shown by two sets of the arrows in FIG. 5 and the peripheries of the electrically conductive layers bulged around the rod.

What is claimed is:

1. A multi-contact interconnector for connecting electric terminal points comprising a plurality of layers of an electrically conductive material and a plurality of layers of an electrically insulating and heat-shrinkable material, at least the electrically conductive material having rubber-like elasticity, the layers of one material and the other material alternately lying one upon another, each electrically insulating and heat-shrinkable layer having a recessed periphery against the flat periphery of each electrically conductive layer.

2. The multi-contact interconnector as claimed in claim 1 wherein the electrically insulating and heat-shrinkable material is a heat shrinkable silicone rubber.

3. The multi-contact interconnector as claimed in claim 1 wherein the electrically insulating, heat-shrinkable material is a heat-shrinkable silicone rubber with uniaxial heat-shrinkability.

4. The multi-contact interconnector as claimed in claim 1 wherein the electrically insulating, heat-shrinkable material is a heat-shrinkable silicone rubber with biaxial heat-shrinkability.

5. The multi-contact interconnector as claimed in claim 1 wherein the electrically conductive material is a silicone rubber filled with carbon black.

6. The multi-contact interconnector as claimed in claim 1 which is a rod-like piece having a circular cross section with the longitudinal axis parallel to the layer-lying direction.

7. The multi-contact interconnector as claimed in claim 1 which is a rod-like piece having a polygonal cross section with the longitudinal axis parallel to the layer-lying direction.

8. A process for manufacturing a multi-contact interconnector for connecting electric terminal points comprising the steps of a. stacking alternately sheets of an electrically conductive material having rubber like elasticity and an electrically insulating and heat-shrinkable material one upon another, each sheet of the electrically insulating and heat-shrinkable material being aligned in the same direction with respect to the axis of heat-shrinkability, b. bonding the stacked sheets to each other to form a block of stratification, c. cutting the block with planes in the direction parallel to that of stratification to form a rod-like piece, and d. subjecting the rod-like piece to heat-treatment at the temperature of heat-shrinkage of the electrically insulating and heat-shrinkable material.

9. A process for manufacturing a multi-contact interconnector for connecting electric terminal points comprising the steps of a. stacking alternately sheets of an uncured electrically conductive silicone rubber and an electrically insulating and heat-shrinkable silicone rubber, each sheet of the electrically insulating and heat-shrinkable silicone rubber aligned in the same direction with respect to the axis of heat-shrinkability.

b. bonding the stacked sheets to each other with heat and under pressure to form a block of stratification, c. cutting the block with planes in the direction parallel to that of stratification to form a rod-like piece, and d. subjecting the rod-like piece to heat-treatment at the temperature of heat-shrinkage of the electrically insulating and heat-shrinkable material.

* * * * *